US007270378B2

(12) United States Patent
Wilkerson et al.

(10) Patent No.: US 7,270,378 B2
(45) **Date of Patent: *Sep. 18, 2007**

(54) CHAIR HAVING A SUSPENSION SEAT ASSEMBLY

(75) Inventors: Larry A. Wilkerson, Comstock Park, MI (US); Mark G. Tomandl, Allendale, MI (US); Keith Page, Holland, MI (US); Gardner Klassen, Ada, MI (US)

(73) Assignee: Haworth, Inc., Holland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/326,850

(22) Filed: Jan. 6, 2006

(65) Prior Publication Data

US 2006/0138849 A1 Jun. 29, 2006

Related U.S. Application Data

(63) Continuation of application No. 10/336,045, filed on Jan. 2, 2003, now Pat. No. 6,983,997, which is a continuation-in-part of application No. 10/186,267, filed on Jun. 28, 2002, now abandoned, said application No. 10/336,045 is a continuation-in-part of application No. 10/209,950, filed on Jul. 31, 2002, now abandoned.

(60) Provisional application No. 60/309,129, filed on Jul. 31, 2001, provisional application No. 60/302,178, filed on Jun. 29, 2001.

(51) Int. Cl.
*A47C 7/02* (2006.01)

(52) U.S. Cl. ..... 297/452.56; 297/452.57; 297/452.13

(58) Field of Classification Search ..... 297/452.56, 297/452.57, 452.13
See application file for complete search history.

(56) References Cited

U.S. PATENT DOCUMENTS 5,788,332 A * 8/1998 Hettinga ..... 297/452.55
6,125,521 A * 10/2000 Stumpf et al. ..... 29/448
6,152,534 A * 11/2000 Maeda et al. ..... 297/452.56
6,540,950 B1 * 4/2003 Coffield ..... 264/257

* cited by examiner

*Primary Examiner*—Laurie K. Cranmer
(74) *Attorney, Agent, or Firm*—Flynn, Thiel, Boutell & Tanis, P.C.

(57) ABSTRACT

A suspension seat assembly for an office chair is provided which has a support frame and a suspension fabric connected about its periphery to the frame. The fabric is first laid across the frame and then the peripheral edges of the suspension fabric are secured in place on the frame by over-molded trim. The suspension fabric may also be formed as a multi-layer composite comprising an aesthetic upper layer, a stretchable suspension layer and an optional cushion layer therebetween. The suspension layer is a fabric-type material which is preferably air permeable and resilient to support the weight of a chair occupant.

18 Claims, 18 Drawing Sheets

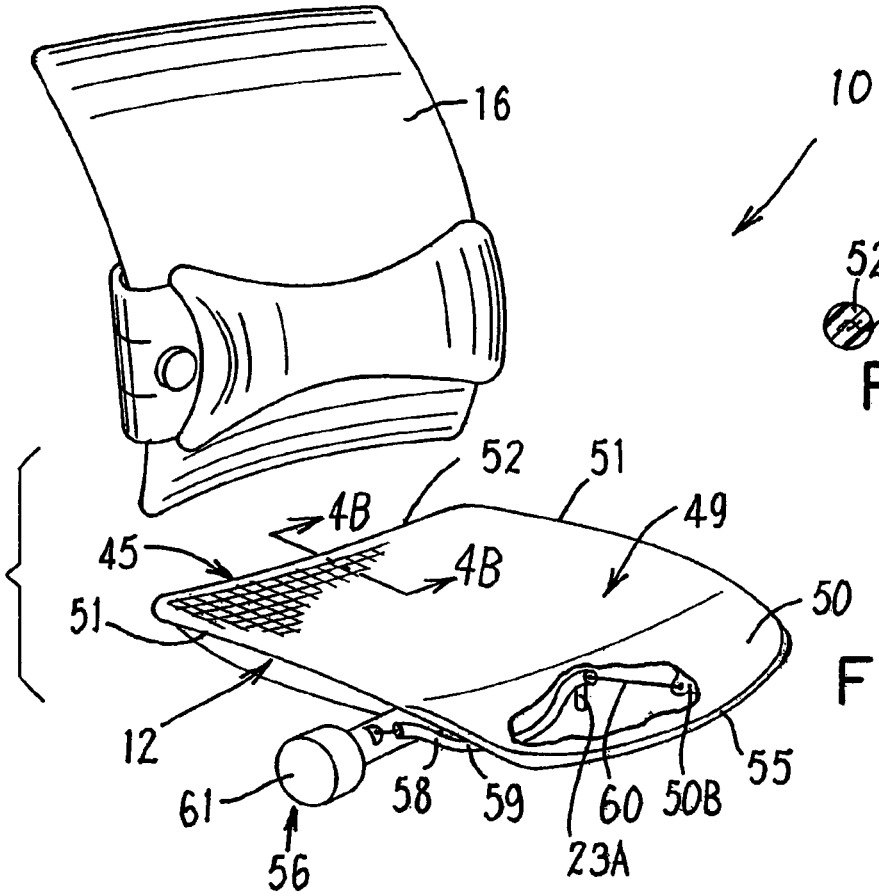
FIG. 4B
FIG. 4A
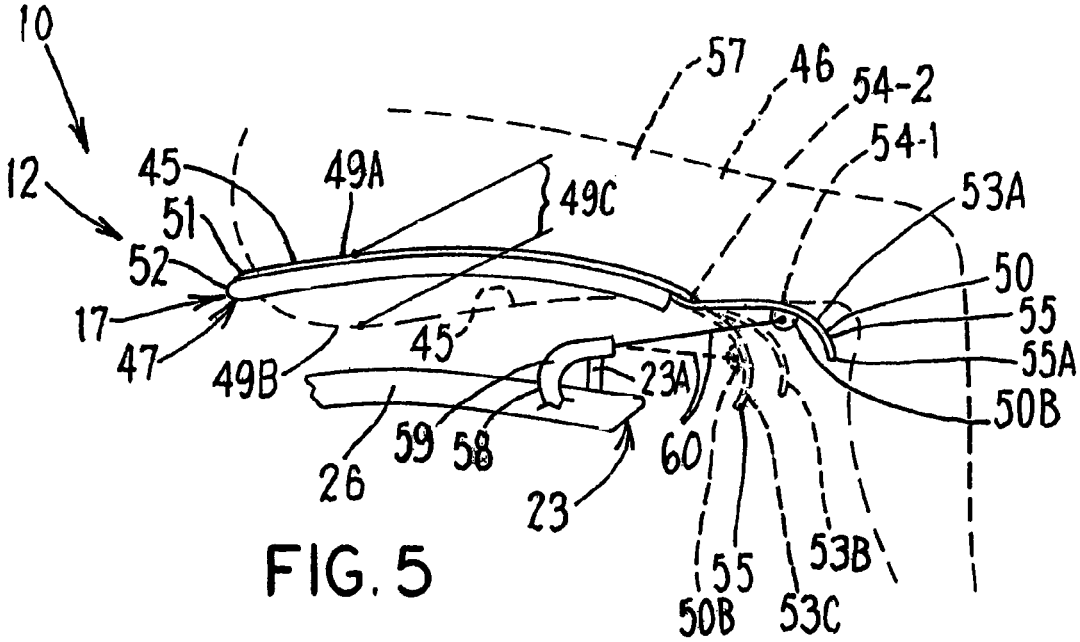
FIG. 5

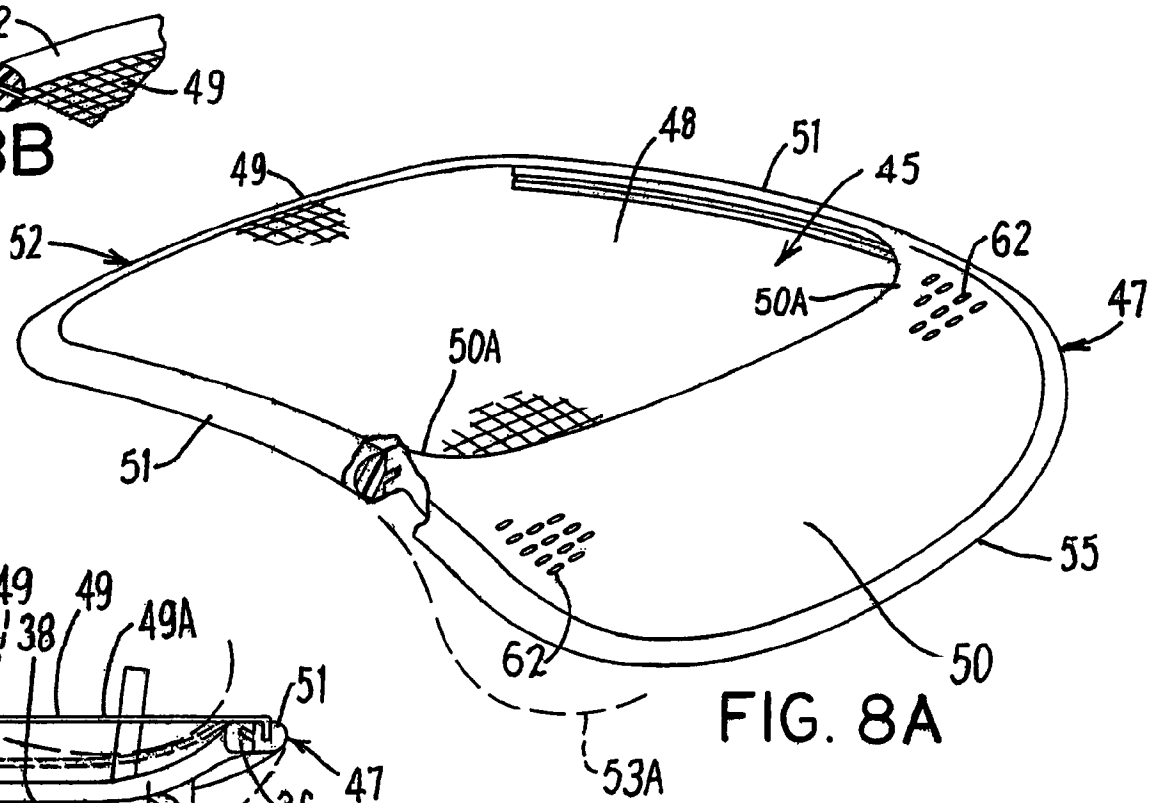
FIG. 8A
FIG. 8B
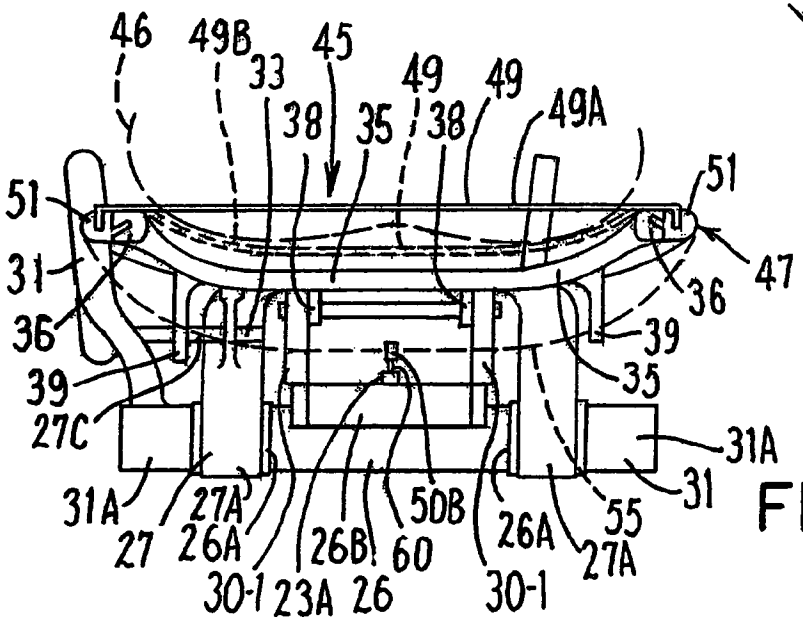
FIG. 9

FIG. 17
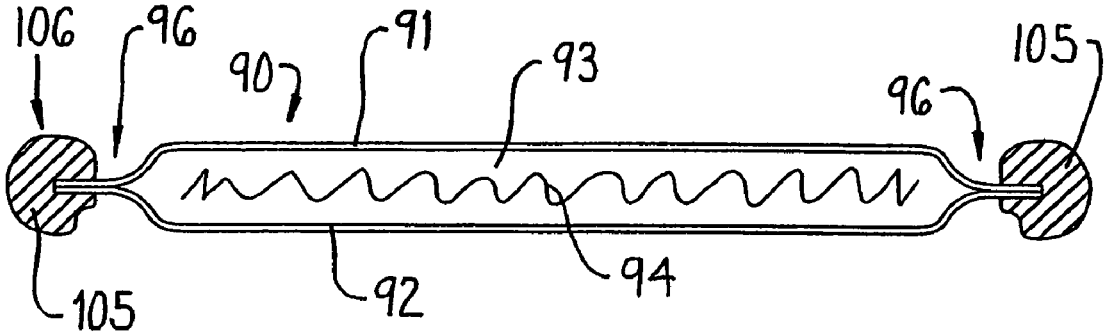
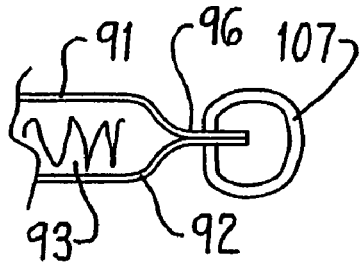
FIG. 18
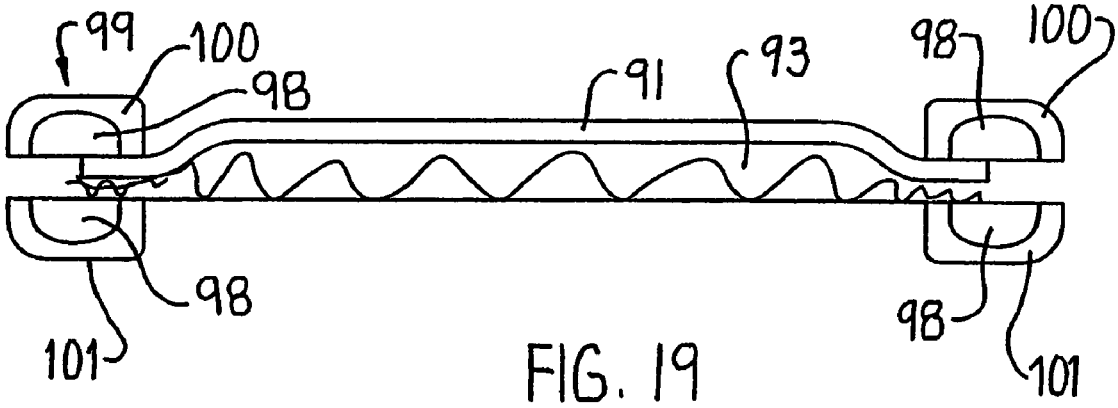
FIG. 19

CHAIR HAVING A SUSPENSION SEAT ASSEMBLY

CROSS REFERENCE TO RELATED APPLICATION

This application is a continuation of U.S. patent application Ser. No. 10/336,045, filed Jan. 2, 2003 now U.S. Pat. No. 6,983,997, which is a continuation-in-part of U.S. patent application Ser. No. 10/186,267, filed Jun. 28, 2002 now abandoned, which claims the benefit of U.S. Provisional Application No. 60/302,178, filed Jun. 29, 2001, and which also is a continuation-in-part of U.S. patent application Ser. No. 10/209,950, filed Jul. 31, 2002 now abandoned, which claims the benefit of U.S. Provisional Application No. 60/309,129, filed Jul. 31, 2001.

FIELD OF THE INVENTION

The invention relates to an improved office chair having a suspension seat assembly, and to methods of making the suspension seat assembly and components thereof.

BACKGROUND OF THE INVENTION

Office chairs include a seat-back arrangement having a horizontally enlarged seat and a back projecting upwardly from a rear edge of the seat. The seat often includes a cushion supported on a plastic support shell to support the occupant thereon. A similar arrangement is used for the back. While the seat conforms to the shape of a user, the deflection of the contour of the seats results from compression of the cushion material. Similar arrangements are used on the back.

In an alternate arrangement, the seat may be formed by a resilient fabric suspended from a frame. Such fabric is unsupported in the middle thereof and may be an open mesh-like material which improves the airflow or breathability of the seat. However, this fabric should be stretched taut to ensure proper support for the occupant.

The invention relates to an improved chair arrangement which uses a resilient fabric, which may be formed as a single layer of fabric material or a multi-layer pad and which is suspended in a frame unit. The suspension fabric is supported about its periphery on the frame unit while the center area thereof is unsupported. The invention relates further to improved constructions for attaching the fabric to the frame unit and for pretensioning the suspension fabric. In this regard, pretensioning may be provided by mounting the fabric to the frame unit and then flexing the opposite sides of the frame unit downwardly when mounting to a base frame section which thereby pulls the fabric taut.

Other objects and purposes of the invention, and variations thereof, will be apparent upon reading the following specification and inspecting the accompanying drawings.

BRIEF DESCRIPTION OF THE DRAWINGS

FIG. 4A is a perspective view of an alternate embodiment of the chair.

FIG. 4B is a partial cross sectional view of a suspension fabric.

FIG. 5 is a side view illustrating a chair occupant seated thereon.

FIG. 8A is an enlarged perspective view of the suspension seat assembly.

FIG. 8B is an enlarged partial perspective view in cross-section of a rear edge of the seat.

FIG. 9 is a front view of the chair.

FIG. 17 is a front elevational view in cross section of a composite cushion.

FIG. 18 illustrates a crimped frame arrangement for the composite cushion.

FIG. 19 is a front elevational view in cross section of a further embodiment of the composite cushion.

Figure 1:
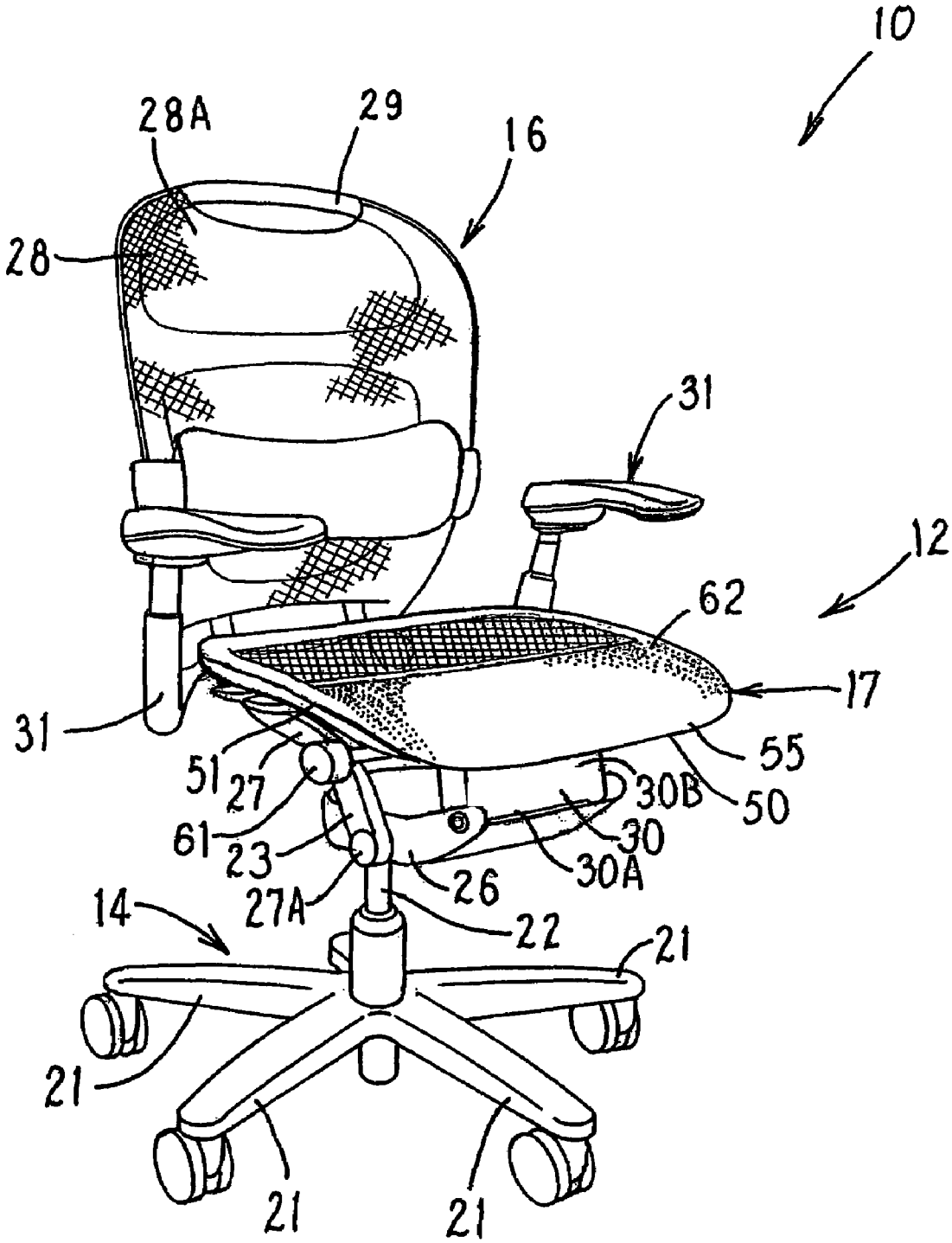
FIG. 1 is a perspective view of a chair having an improved suspension seat assembly and suspension back assembly.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the system and designated parts thereof. Said terminology will include the words specifically mentioned, derivatives thereof, and words of similar import.

DETAILED DESCRIPTION

Referring to FIG. 1, a chair 10 is illustrated having a seat unit 12 supported on a pedestal or base 14 and a back unit 16 pivotally connected to the pedestal 14. The chair 10 includes an improved suspension seat assembly 17 and suspension back assembly 28.

Generally, the office chair 10 includes the base 14 having legs 21 radiating outwardly from a lower end of a vertical post 22. The outer ends of the legs 21 include conventional casters which support the office chair 10 on a floor or other similar surface.

The upper end of the pedestal 22 rigidly supports the seat unit 12 thereon. In particular, the seat unit 12 includes a structural seat frame 23 and the horizontally enlarged suspension seat assembly 17 which seat assembly 17 overlies and is supported on the seat frame 23.

Figure 3:
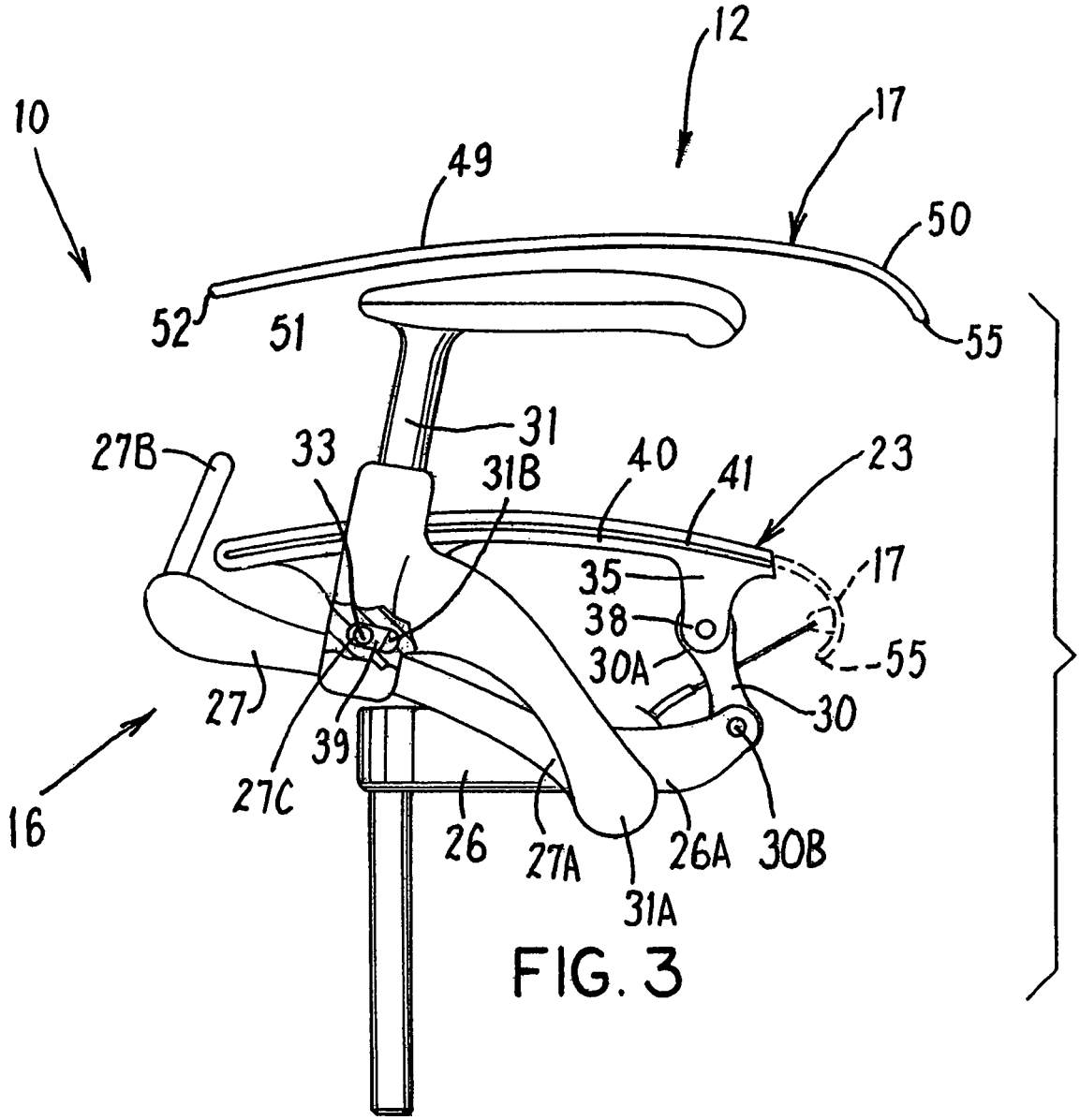
FIG. 3 is an exploded side view of a structural frame and the suspension seat assembly therefor.

Referring to FIG. 3, the base 14 generally includes a rigid arm 26 which is rigidly connected to the pedestal 22 and is cantilevered outwardly therefrom, and an L-shaped upright 27 which is pivotally connected to the arm 26 by a pivot connection 27A. The upper end 27B of the upright 27 supports the back unit 16 thereon. The back unit 16 includes the vertically enlarged suspension back assembly 28 that has a suspension fabric which supports the body of the chair occupant and a back frame 29 on which the suspension fabric 28A is connected.

The base 14 further includes a front link 30 which is pivotally connected at a lower end 30A to the front 26B of the front arm 26 forwardly of the upright 27. The seat frame 23 is pivotally connected to the upper end 30B of the front link 30 and also to the lower portions 27A of the upright 27 at connecting points 27C to thereby define a four-bar linkage which governs simultaneous tilting of the seat unit 12 and the back unit 16. The four-bar linkage includes a spring arrangement to resist tilting wherein the linkage and spring arrangement effectively define a tilt control unit.

A pair of support arms 31 also are pivotally connected to opposite sides of the arm 26 at the intermediate arm portions 26A by lower ends 31A. Further, the support arms 31 have a slot 31B therein which receives a pivot pin 33 slidably received therein. As a result, rearward tilting of the back unit 16 causes a corresponding downward tilting of the seat unit 12 about the front link 30 and a corresponding pivoting movement of the arms 31.

Referring to the seat frame 23 (FIGS. 3, 10 and 11), the seat frame 23 includes a pair of cross bars 35 which extend sidewardly or laterally and have opposite ends that curve upwardly and support side frame rails 36 thereon. The side frame rails 36 are laterally spaced apart and extend generally forwardly to define opposite side edges of the seat unit 12.

Figure 10:
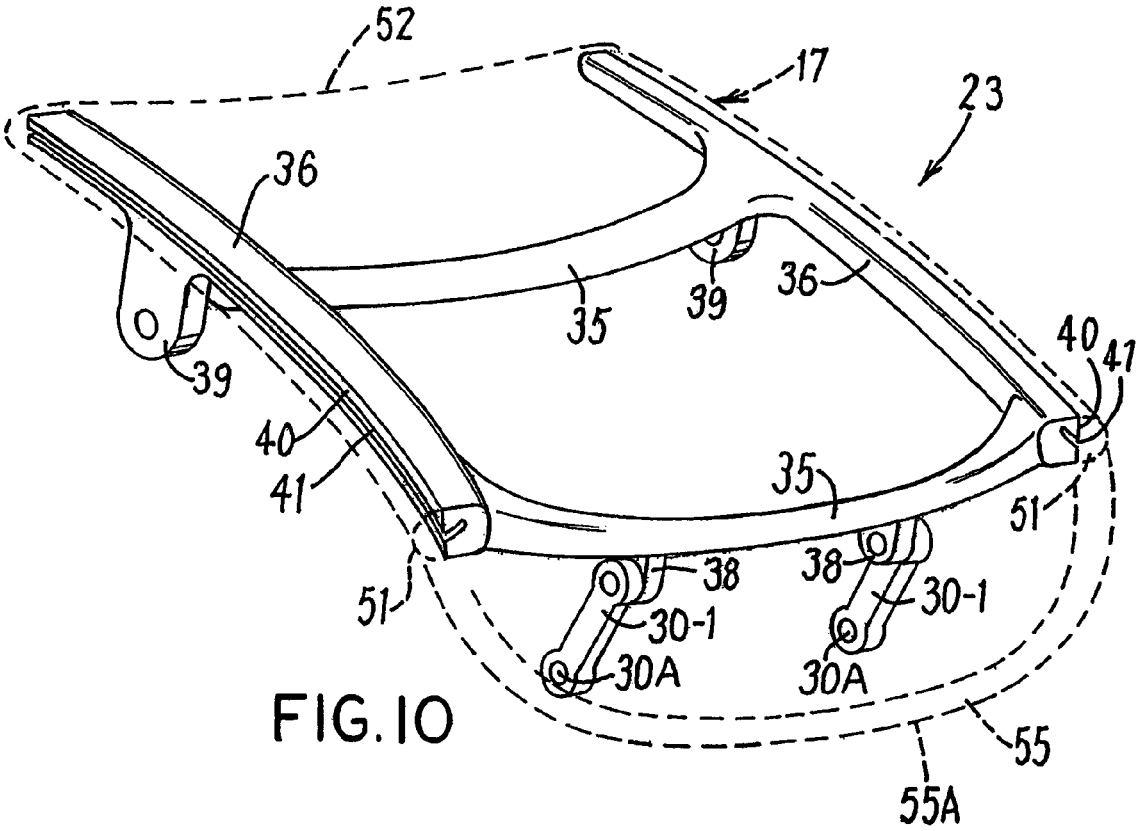
FIG. 10 is a top front perspective view of a seat frame.
Figure 11:
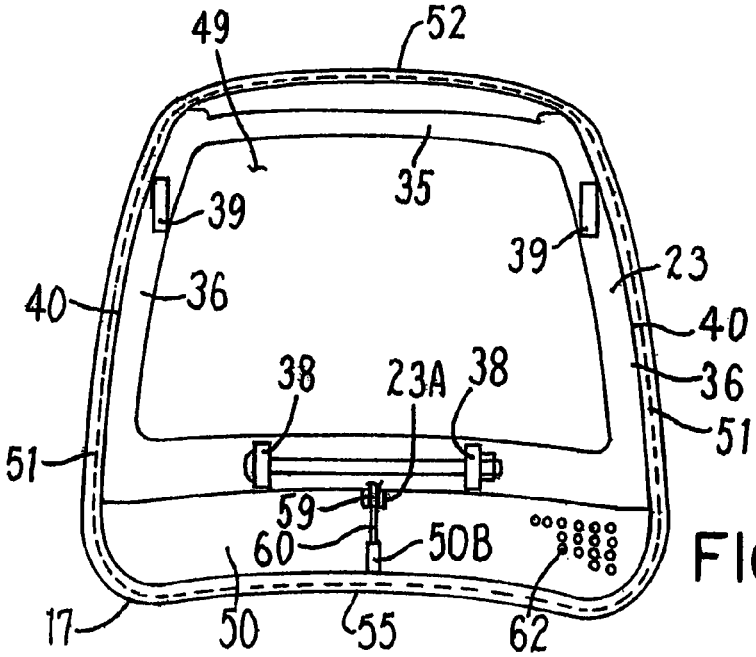
FIG. 11 is a bottom view of the seat frame.

The front cross bar 35 includes a pair of pivot flanges or ears 38 which project downwardly therefrom and are pivotally connected to the upper ends 30B of the front link 30. As seen in FIGS. 9 and 10, the plate-like front link 30 of FIGS. 1-3 could also be formed as two separate links 30-1. Near the opposite ends of the rear cross bar 35, a pair of additional pivot flanges 39 are provided which are pivotally connected to the upright 27. Accordingly, the seat frame 23 defines a generally horizontal link of the four-bar linkage.

Each side rail 36 includes an outer face 40 which has a groove 41 formed therein. The groove 41 (FIG. 6B) extends inwardly into the material of the side rail 36 and in the illustrated embodiment, angles generally upwardly. The grooves 41 of the side rails 36 are provided to support the opposite side edges of the suspension seat assembly 17 as described herein.

The seat frame 36 is formed of a rigid, molded material such as PET.

Referring to the suspension seat assembly 17 (FIGS. 1, 2, 8 and 9), this assembly 17 defines an upward facing support surface 45 on which the seat of an occupant 46 is supported as seen in FIGS. 5 and 9. The seat assembly 17 includes a molded shell 47 having a generally annular shape which defines a central opening 48, and a suspension fabric 49 which is connected about its periphery to the shell 47. The fabric 49 is an air-permeable and elastomeric membrane or mesh which provides improved comfort for the occupant 46. For example, the fabric 49 can be a woven material using fibers of a TEEE material such as Hytrel and polyester, and the frame may be made of molded Hytrel. The fabric 49 may be made of other low-creep, elastomeric materials and be either woven or an air-permeable membrane.

The mesh 49 is normally in an undeflected condition as indicated by reference line 49A in FIGS. 5 and 9. When the occupant 46 sits thereon, the mesh deflects an amount defined by the weight of the user as indicated by the deflected position 49B. The difference between the positions 49A and 49B is the total deflection of mesh 49C.

More particularly, the shell 47 comprises an enlarged front panel 50 which defines a front edge or lip 55 of the shell 47, a pair of laterally spaced apart side supports or edgings 51 which extend rearwardly from the front panel 50 and a rear bead 52 which extends laterally between and is connected to the rear ends of the edgings 51. These shell sections preferably are molded together wherein the peripheral edges of the suspension fabric 49 are encapsulated within the shell material 47 during the molding process.

Figure 6A:
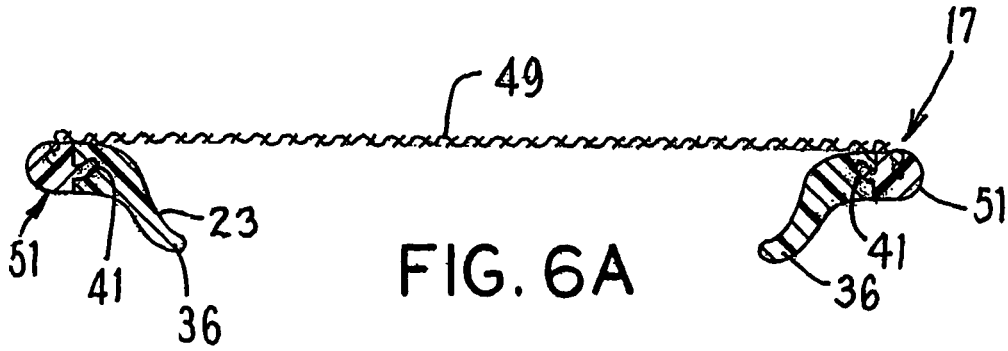
FIG. 6A is a front view of a suspension seat assembly.
Figure 6B:
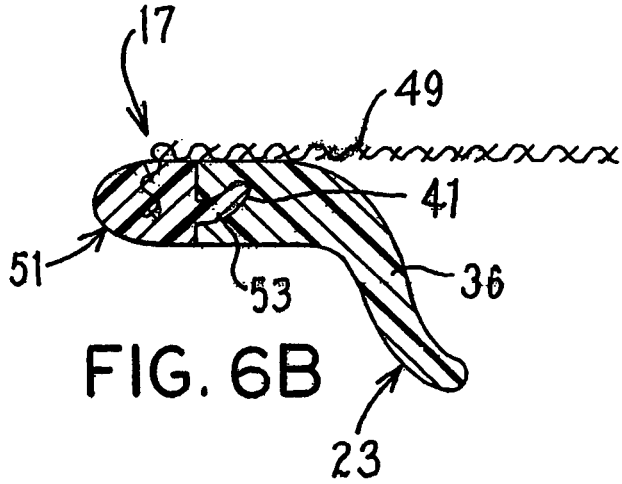
FIG. 6B is an enlarged edge detail of the seat assembly.
Figure 7:
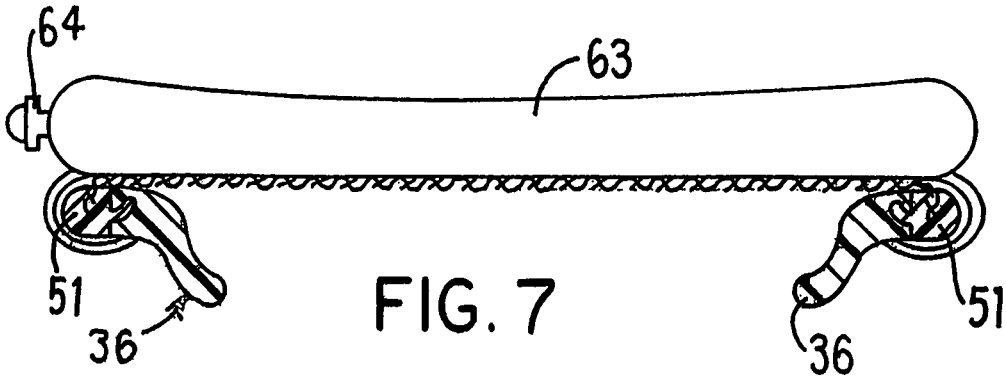
FIG. 7 is a front view of a modified version of the seat assembly.

Referring to FIG. 6B, the edgings 51 thereof are adapted to be deformed outwardly and then snapped onto the side frame rails 36 of the structural frame 23. In particular, the edgings 51 have an inwardly projecting tongue or rib 53 (FIG. 6B) which is adapted to be fitted into the corresponding groove 41 of the side rail 36. As such, a tongue and groove connection is provided between each shell edging 51 and the frame side rail 36 connected thereto. The edgings 51 thereby define bull-nosed protective edges. When the edgings 51 are connected on the frame rails 36, the edgings 51 preferably are formed of a material which is more deformable than the frame rail 36 so that each edging 51 serves as a relatively soft, side bumper which protects against injury of the occupant when the occupant bumps into the side of the chair.

Therefore, the suspension seat assembly 17 is rigidly connected to but is only supported along its opposite side edges on the frame rails 36. This is accomplished by spreading the edgings 51 laterally apart from each other and snapping the edgings 51 onto the frame rail 36. Notably, however, the flexible front panel 50 and the rear bead 52 are not supported vertically on any underlying frame work 23 but instead extend laterally between and in effect are suspended from the side frame rails 36. Since the structural frame 23 is rigid, the edgings 51 have little if any inward deflection toward each other when the suspension fabric 49 is placed under load by the occupant as seen in FIGS. 5 and 9. Further, the front panel 50 has a relatively large width in the front to rear direction and thus has little if any deflection rearwardly when the suspension fabric 49 is loaded.

However, the rear bead 52 has a relatively small cross-sectional area, for example, as seen in FIG. 8 and is deflectable not only downwardly but also forwardly under load. The rear bead 52 still has sufficient rigidity to return the suspension fabric 49 to a normal undeflected condition (FIG. 8) and also maintain the fabric 50 taut in this condition. However, the rear bead 52 also deflects to permit the suspension fabric 49 to conform to the shape of the seat of the occupant 46 as generally illustrated in FIGS. 5 and 9.

As to the front panel 50, the center section of the front panel 50 is deflectable downwardly near the juncture between the fabric 49 and the front panel 50. In other words, the deflection of the front panel 50 progressively increases or bows laterally towards the center.

Also, the front panel 50 is connected to and extends forwardly from the side rails 36 in cantilevered relation therewith. The front panel 50 is deflectable or generally pivotable also at the front lip 55 thereof to permit downward deflection of the front lip 55. To avoid formation of a sharp hinge line which extends laterally between the front ends of the side rails 36, the front panel 50 preferably has curved corners 50A. The added material of the corners 50A tends to cause bending of the front panel 50 about a larger radius of curvature and avoids a sharp hinge line.

More particularly, the front panel 50 is able to bow under the weight of the user to conform to the occupant's shape. The front lip thereof also may deflect downwardly to the deflected position illustrated in phantom outline in FIG. 8.

FIGS. 1 and 5 illustrate the front panel 50 in an undeflected position wherein the front panel 50 extends generally horizontally to support the thigh 57 of the occupant 46. Since the front panel 50 is resilient and generally cantilevered relative to the frame 23, the front panel 50 is thereby resiliently deflectable downwardly. The resilience of the front panel 50, however, normally biases the front panel 50 upwardly. When the front panel 50 is completely unrestrained, it maintains the generally horizontal position indicated by reference arrow 53A. Under the influence of the occupant 46 such as the weight of the occupant or movements of the occupant, the front panel 50 may deflect resiliently downwardly, for example, to the position diagrammatically illustrated by reference line 53B or a further deflected position identified by reference line 53C.

Additionally, while the front panel 50 may deflect downwardly in response to the weight of the occupant, an adjustment mechanism 56 (FIG. 4) also is provided to pull the front lip 55 of the front panel 50 downwardly and thereby adjust the contact location 54-1, 54-2 (FIG. 5) of the front panel 50 with the thigh 57 of the occupant. As seen in FIG. 5, the adjustment mechanism 56 includes a pull cable 58 which has a sheath 59 that is fixed to a flange 23A on the chair frame 23 and an inner cable 60 which extends forwardly and is connected to a flange 50B on the underside of the front panel 50.

Figure 2:
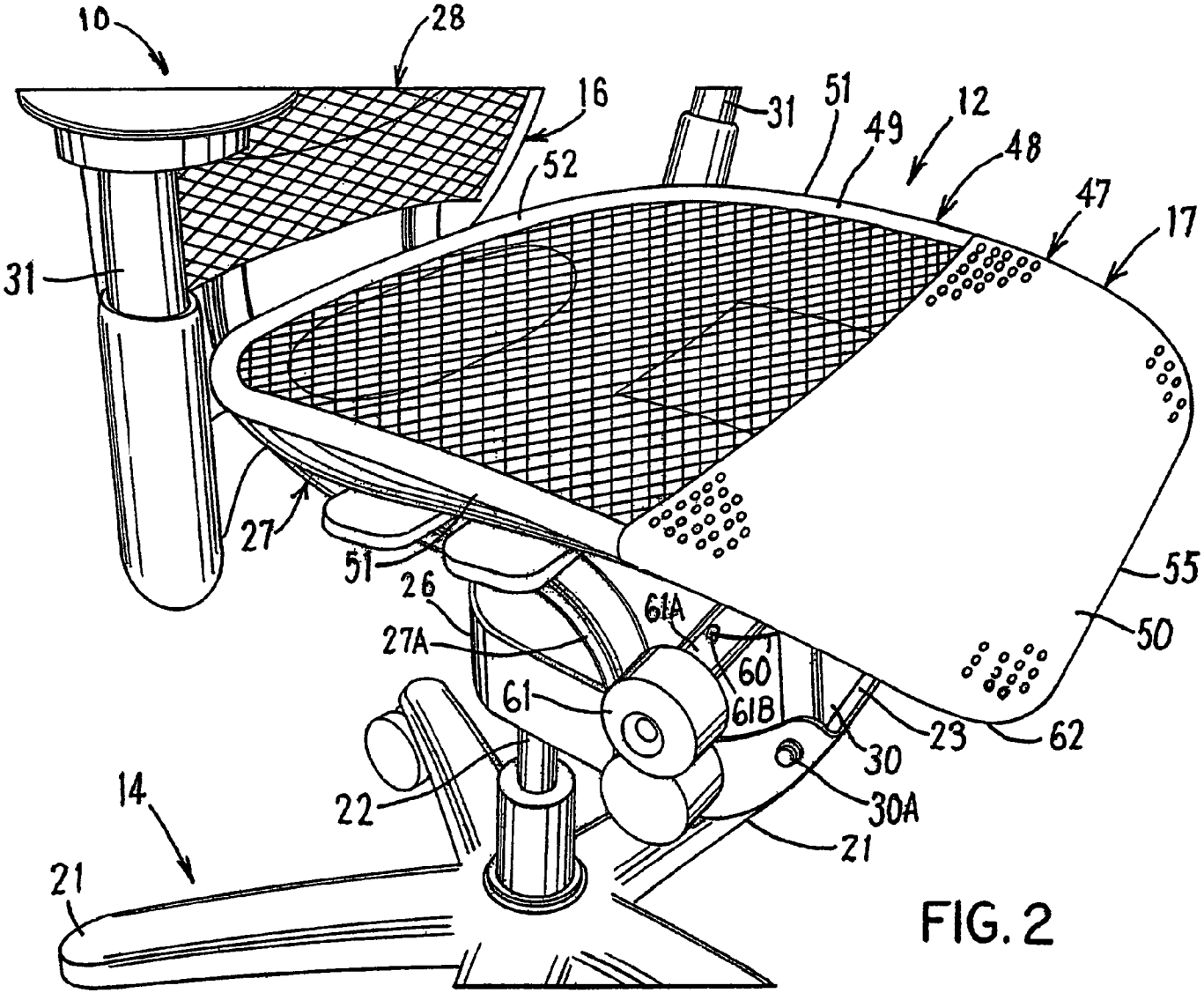
FIG. 2 is an enlarged perspective view of the suspension seat assembly.

An adjustment handle 61 (FIG. 4) is connected to the cable 60 to pull and in effect deflect the front panel 50 downwardly as seen in FIG. 5. As seen in FIG. 2, the handle 61 has a rotatable shaft 61A and a connector flange 61B located on the shaft 61A. The cable 60 is connected to the flange 61B such that rotation of the shaft 61A pulls the cable 60 to pull the front panel 50 downwardly. This adjusts the contact point 54-1 or 54-2 of the front panel 50 with the occupant 46 and thereby adjusts the overall length of the seating area as measured in the front to back direction. Since the cable 60 is under tension, this arrangement permits the front panel 50 to deflect downwardly but limits upward movement of the front panel 50. If flexing of the front panel 50 is not desired in the downward direction, a rigid lever also may be provided which controls the deflection of the front panel 50 but limits downward flexing thereof.

The front panel 50 also is perforated with apertures 62 to facilitate air flow to the occupant's legs and perform a function similar to the air-permeable or open-weave suspension fabric 49.

Also, the suspension seat assembly 17 may have an inflatable cushion 63, wherein inflation thereof is controlled by a pump/valve unit 64.

In the above arrangement, the suspension assembly 17 is molded separately and then snap fit onto the frame 23. Alternately, the suspension fabric 49 may be first connected to a frame in a first molding process and then the remainder of the seat suspension assembly 17 molded to the seat frame.

Figure 12:
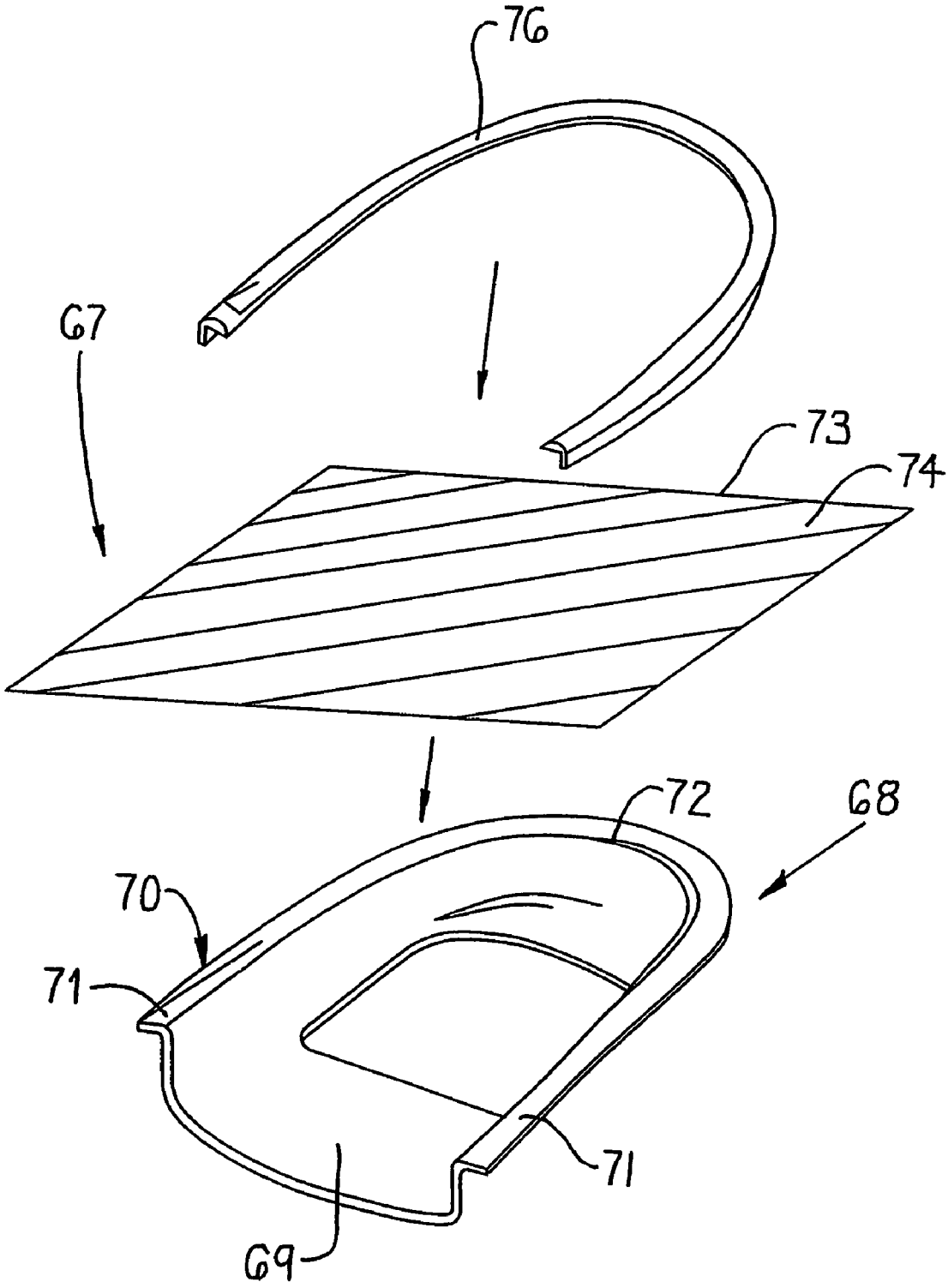
FIG. 12 is a front perspective view of an alternate arrangement for connecting the seat suspension assembly 17 to a seat frame.

Referring to FIG. 12, in this arrangement, the seat frame 68 has a pan-like shape defined by a bottom wall 69 and a frame edge 70 which comprises side edges 71 and a back edge 72. It will be understood that the frame 68 may be formed only with the side edges 71 so that a back edge 73 of a suspension fabric 74 is carried by a relatively small rear bead like in the seat suspension assembly 17 described above. In the arrangement of FIG. 12, the seat frame 68 has the suspension fabric 74 placed on the top surface of the edge flanges 70 and then a trim piece 76 is applied thereto to maintain the suspension fabric 74 connected to the seat frame 68 until the suspension seat assembly 17 is molded thereon. The seat suspension assembly 67 in this arrangement is formed substantially the same as the seat suspension assembly 17 described above in that a flexible front panel is provided like front panel 50.

Figure 13:
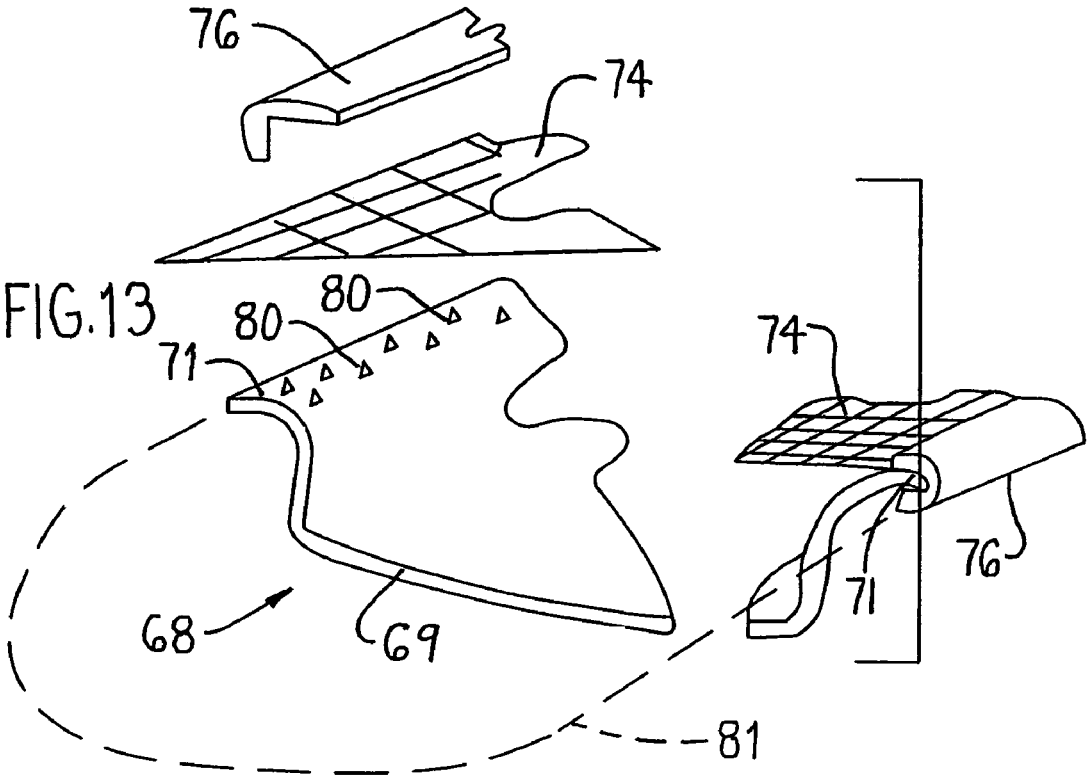
FIG. 13 is a perspective view of a first connection method.

Referring to FIG. 13, one attachment process is illustrated wherein the suspension fabric 74 is stretched laterally and possibly in the forward to rearward direction and then laid onto a plurality of pins 80 formed in the edge flanges 71. These pins 80 maintain the membrane 74 in a stretched condition and then the trim piece 76 is molded in place on the seat frame 68 with a general U-shape to maintain the suspension fabric 74 in the stretched condition. Thereafter, the remainder of a shell like the shell 47 is over molded onto this unit to thereby define a front panel 81.

Figure 14:
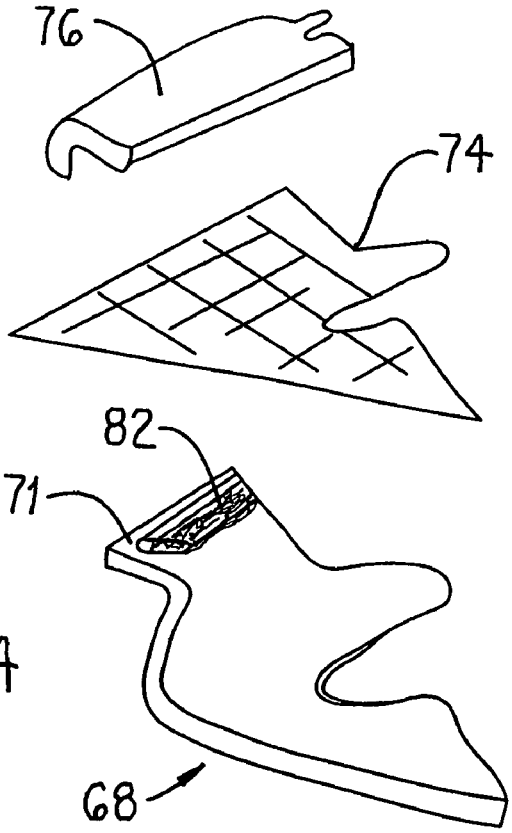
FIG. 14 is a perspective view of a second connection method.

FIG. 14 illustrates an alternate arrangement wherein the suspension fabric 74 is chemically bonded to the edge flanges 71 of the seat frame 68 by an adhesive 82 to maintain the fabric in the stretched condition. Again a trim piece is molded onto the frame edges.

Figure 15:
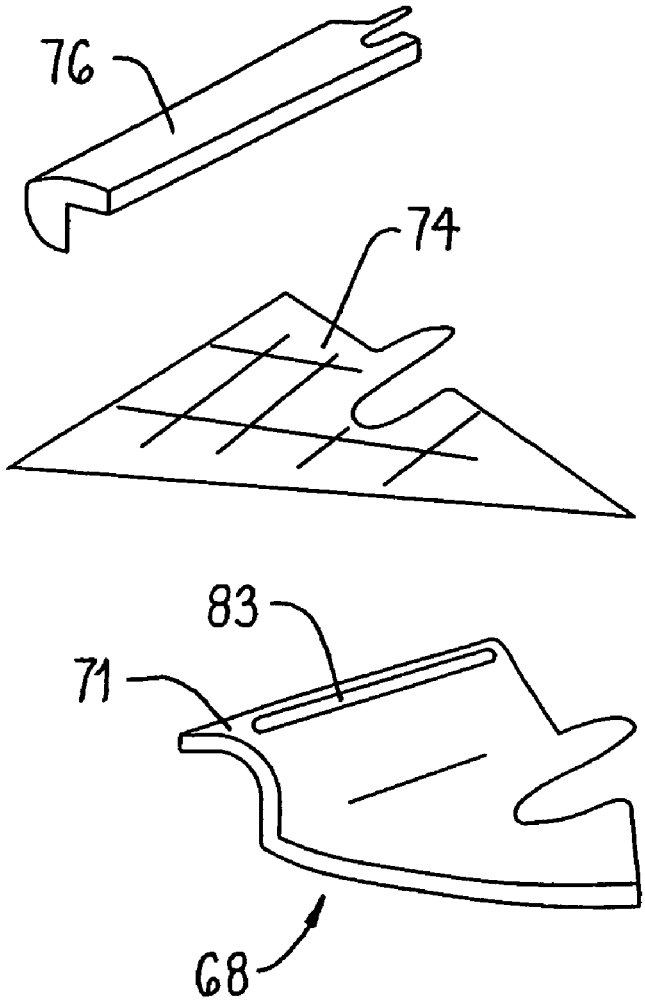
FIG. 15 is a perspective view of a third connection method.

Referring to FIG. 15, the suspension fabric 74 also could be thermally bonded to the frame edges with heat, sonic or radio energy to a fusible strip 83.

Figure 16:
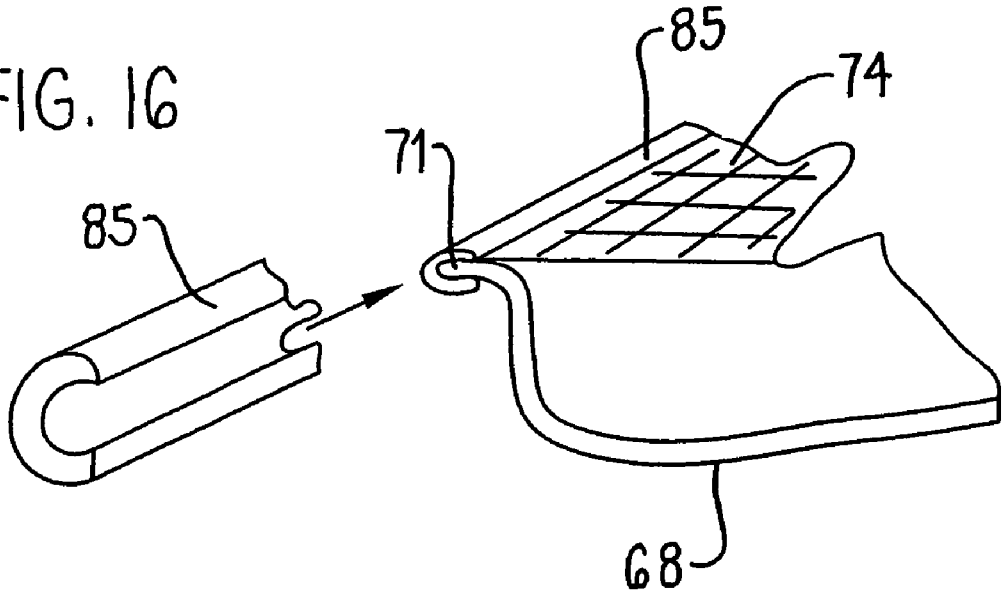
FIG. 16 is a perspective view of a fourth connection method.

In FIG. 16, the suspension fabric or web is placed on the frame 68 such as with the above described methods of pins, adhesive or bonding. Thereafter, a trim member 85, which is formed as a mechanical crimp, is snapped onto the frame edges 71.

The foregoing disclosure references the use of a preformed fabric such as a membrane or woven web. However, the suspension fabric also may be molded in place wherein mold jaws are provided which span the frame edges and mold the membrane so that it stretches across or spans the space between the frame edges and actually wraps around and encapsulates the frame edges therein.

In addition to the above described suspension fabrics, the suspension fabric may also be formed as a composite seat pad as illustrated in FIGS. 17 to 19.

In a first embodiment of the composite seat pad 90, the pad 90 comprises an upper layer 91 of an upholstery fabric of a suitable material, and a backing material 92 which preferably is an elastomeric stretchable fabric such as the material used above the suspension fabric 49. Further, a thermoplastic non-woven pad or cushion layer 93 is provided between the upper layer 91 and the backing material 92. This intermediate pad 93 is formed of a thermoplastic non-woven material (TPE) and is heat processed to cross-link the fibers therein. All three of these layers 91, 92 and 93 are compressed and heated together in the manufacturing process so that the edge sections thereof are bonded together. These edge sections then may be encapsulated within a suitable seat suspension shell such as the shell described above.

More particularly, the upper layer 91 is a suitable finish material such as polyester fabrics, leather or the like. The intermediate layer 93 preferably is a needle punched pad 94 of a thermoplastic material which is initially provided with a relatively large thickness of approximately one inch. The backing material 92 preferably is a suspension fabric as referenced above such as a woven Hytrel material. These three layers are laid together one above the other prior to the manufacturing process. During the manufacturing process, the peripheral edge areas 96 of this composite are placed into a press. Where the top layer 91 is a polyester or other similar material which will bond upon heating, then no additional adhesives are provided. However, where the top layer 91 is a different type of material such as leather, an additional adhesive material may be required in the perimeter region in order to bond the top layer 91 to the intermediate pad 93 and the backing layer 92.

Thereafter, the edge regions 96 are clamped about the perimeter and also heated to fuse the perimeter sections together. For example, as seen in FIG. 19, a hot plate 98 may be provided in the jaws 100, 101 of the clamp 99 which only heats the edges. In this one operation where the perimeter of the pad 94 is being melted or heat fused, additional heat and a downward weight or pressure is applied to the central portion of the fabric 91 to heat and compress the needle punched pad 93. The needle punched pad 93 is heated to the glass transition temperature thereof such that the individual fibers of the pad 93 are cross linked together. The resultant pad 93 thereby has a smaller thickness but is compressible downwardly and yet has significant strength in the lateral direction. The TPE material of the needle punched pad 92 therefore not only is meltable, but results in an intermediate pad 92 which serves as a cushion and also is air permeable to permit air flow through the composite pad. This arrangement further provides a top layer 91 which is relatively smooth and has a desirable aesthetic appearance. It has been found that woven fabrics such as fabric 49 can cause increased wear of clothing and this arrangement still provides a suspension fabric for a suspension seat assembly but has a more desirable top surface while also providing air flow through the composite pad.

Referring to FIG. 18, while the embodiment of FIG. 17 may be encapsulated within the molded frame edges 105 of a shell 106, it also is possible to mechanically crimp a frame rail 107 onto the compressed edge portions 96 of the composite pad 90 as seen in FIG. 18.

Referring to FIG. 19, the backing material 92 also may be eliminated as seen in FIG. 19. In this arrangement, the top layer 91 and needle punched pad 93 are formed with substantially the same process as described above but in this condition, the needle punched pad 93 serves as a cushion and an elastomeric suspension layer. In this arrangement, Hytrel fibers (TEEE material) may be provided directly in the needle punched pad to provide an additional elastomeric characteristic or to enhance the elastomeric characteristic of the needle punched pad 92.

Referring to FIGS. 20-28, a further embodiment of a chair is illustrated therein as designated by reference numeral 190. The chair 190 includes components thereof which are substantially identical to those of the chair of FIGS. 1-2 and common components are identified by the same reference numerals.

In particular, the chair 190 includes a base 14 having a post 22 and a support arm or housing 26. A four-bar linkage is defined by an upright 27, a front link 30 and a structural seat frame 23-1 which forms part of the seat assembly 17-1.

Figure 20:
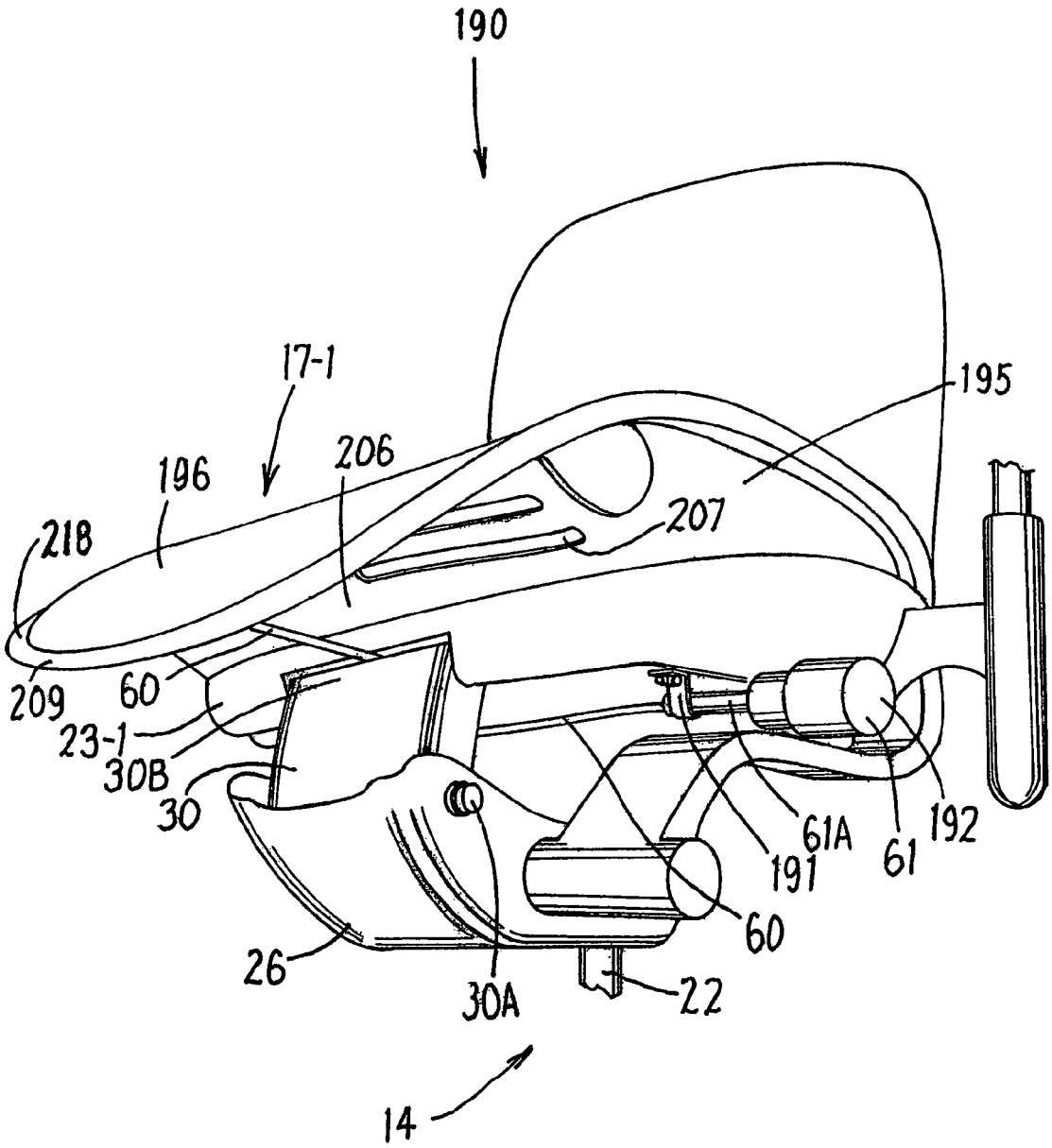
FIG. 20 is a perspective view of a further embodiment of a chair.
Figure 21:
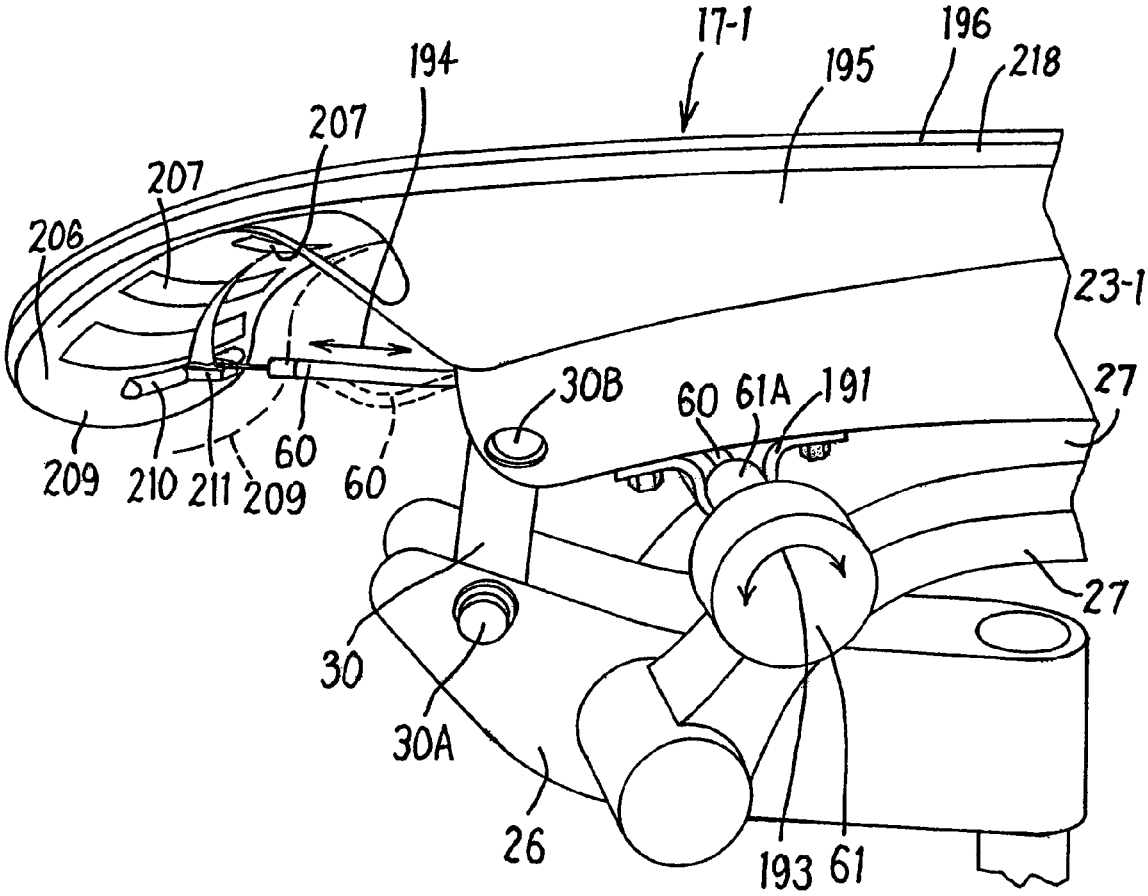
FIG. 21 is a side perspective view of the chair.
Figure 22:
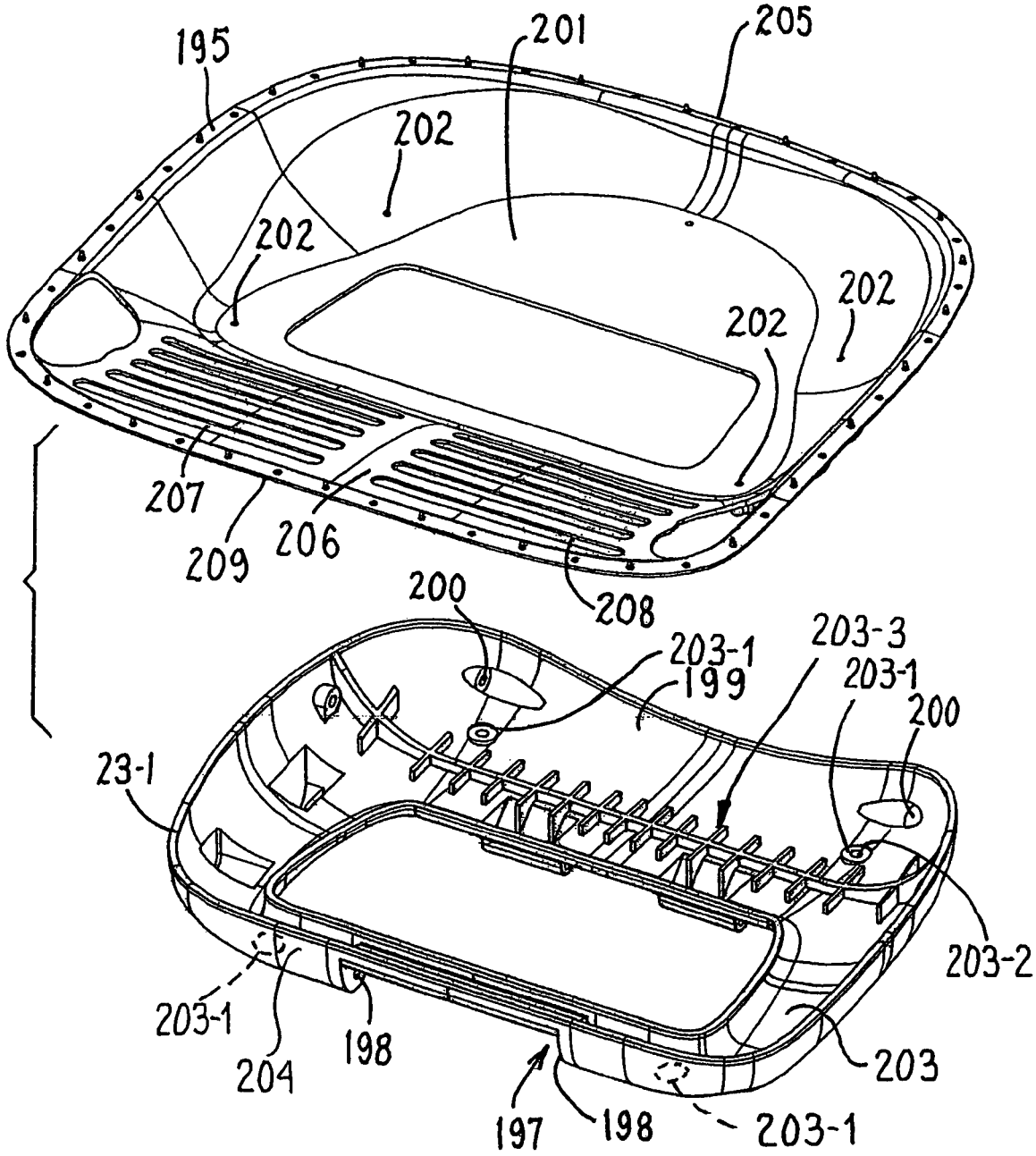
FIG. 22 is a perspective view of the support frame and molded support shell for the chair of FIGS. 28 and 29.
Figure 23:
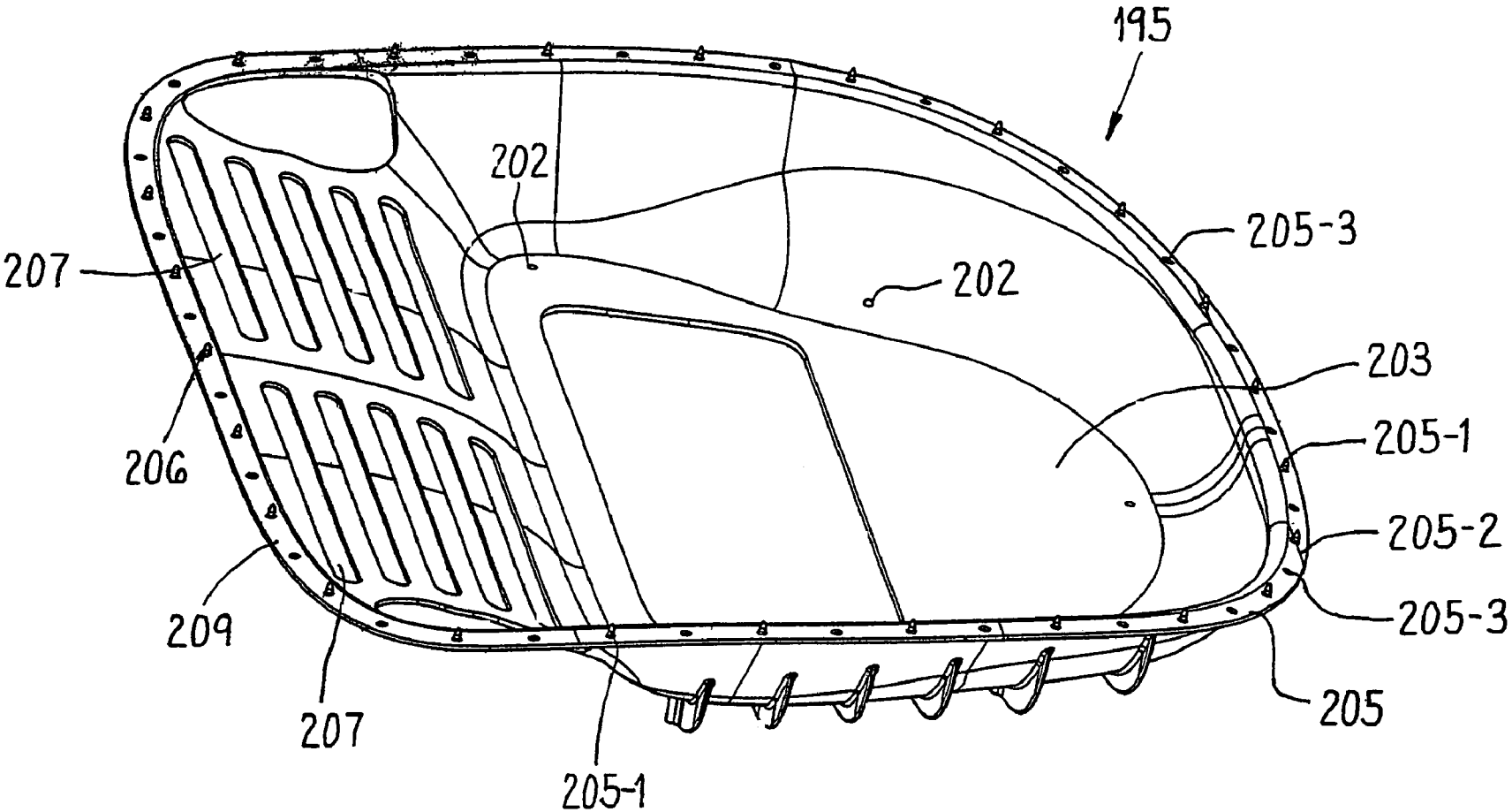
FIG. 23 is a perspective side view of the molded shell.
Figure 24:
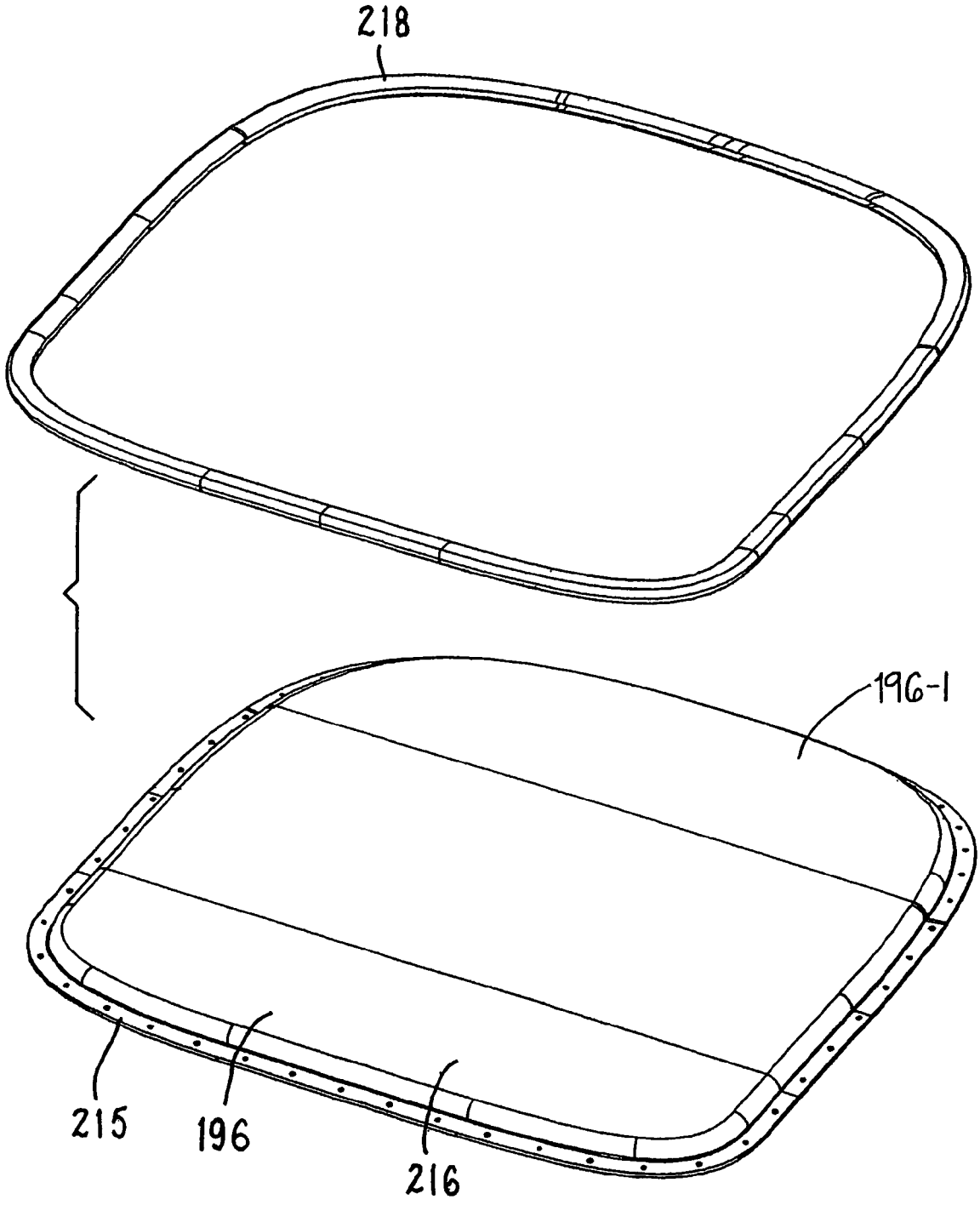
FIG. 24 is a perspective view of the seat pad and trim ring which are supported on the seat shell of FIG. 30.

The chair 190 further includes an adjustment handle 61 which is fixedly mounted to the support frame 23-1 by a mounting bracket 191. The adjustment handle 61 is formed substantially the same as that of FIG. 1 except that it is mounted to the opposite side of the chair in FIG. 20. The handle 61 includes a manually-rotatable knob 192 which is connected to the shaft 61A. A cable 60 is connected between the adjustment handle 61 and the front edge of the seat assembly 17-1 as described in further detail herein. The cable 60 extends between a gap defined between the upper end 30B of the front link 30 and an adjacent edge of the support frame 23-1 as seen in FIG. 20. Rotation of the handle 61 as indicated by reference arrow 193 causes a corresponding linear movement of the cable 60 as indicated by reference arrow 194.

The primary distinction between the chair 190 and the chair 10 of FIG. 1 is in the construction of the seat assembly 17-1. In the seat assembly 17-1, a molded seat shell 195 is provided in combination with a cover pad 196 as separate components rather than being molded together as in the seat assembly 17 of FIG. 1.

More particularly as to the seat assembly 17-1, the support frame 23-1 (FIG. 22) is formed of a rigid material and has a front window 197 through which the front link 30 is received. The opposite sides of the window 197 include pivot mounts 198 to which the upper end 30B of the front link 30 is pivotally connected. The rear wall 199 of the support frame 23-1 also includes further pivot mounts 200 to which the separate arms of the upright 27 are pivotally connected in a four-bar linkage arrangement.

The bottom wall 203 of the frame 23-1 includes four cylindrical fastener anchors 203-1 formed with fastener bores 203-2 extending vertically therethrough. The fastener anchors 203-1 are located near the corners of the frame 23-1 adjacent the rear wall 199 and the front wall 204 near the window 197.

Additionally, a central strengthening rib structure 203-3 extends laterally across the frame 23-1. The rib structure 203-3 has a central lateral main rib and short ribs extending forwardly and rearwardly from the main rib.

The support shell 195 (FIGS. 22 and 23) includes a bottom wall 201 formed with mounting holes 202 by which the support shell 195 is fastened to the support frame 23-1. The holes 202 align with the bores 203-2.

The shell 195 includes an upper rim 205 and a flexible front panel 206 which functions similar to the front panel 50 described above. The front panel 206 is formed with two rows of parallel slots 207 which facilitate downward flexing of the front edge 209 of the shell 195.

The bottom surface of the front panel 206 is formed with a horizontally elongate mounting rib 210 as seen in FIG. 29. The adjustment cable 60 includes a mounting clip or bracket 211 on the front end thereof which is affixed to the mounting rib 210 to join the cable 60 and the front shell section 206 together. As such, pulling of the cable 60 in the direction of arrow 195 causes a corresponding flexing movement of the front edge 209. As indicated in phantom outline in FIG. 29, flexing of the front panel 206 causes a downward movement of the front shell edge as indicated in phantom outline since the cable 60 is flexible and is able to bow as also indicated in phantom outline in FIG. 21. Therefore, in this arrangement, the cable 60 is connected directly to an underlying support shell wherein a separate suspension cushion 196 is suspended thereon.

Figure 25:
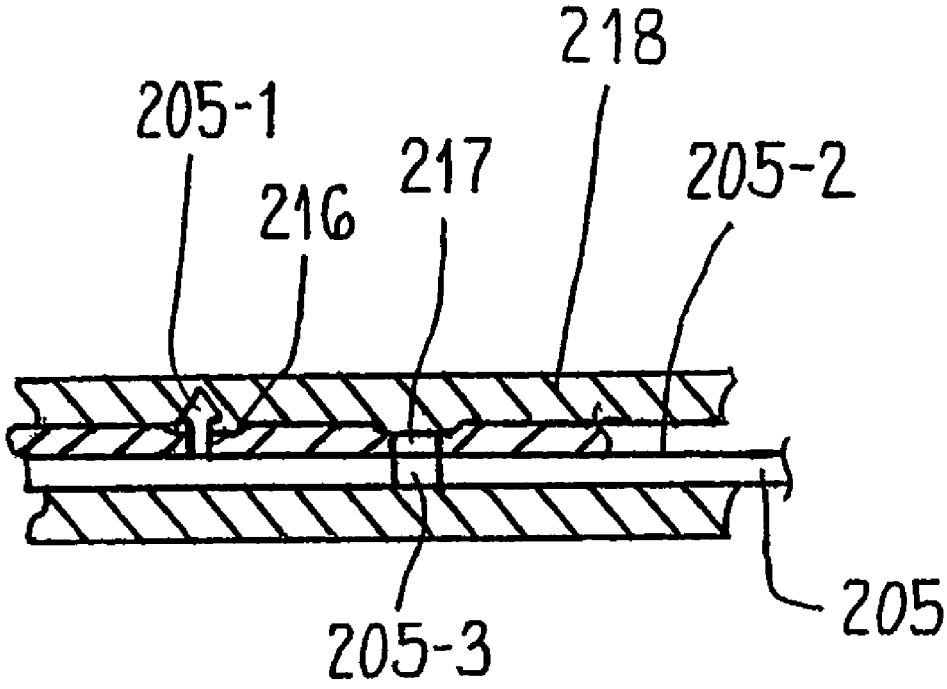
FIG. 25 is a side cross-sectional view of a suspension membrane mounted to the support shell.
Figure 26:
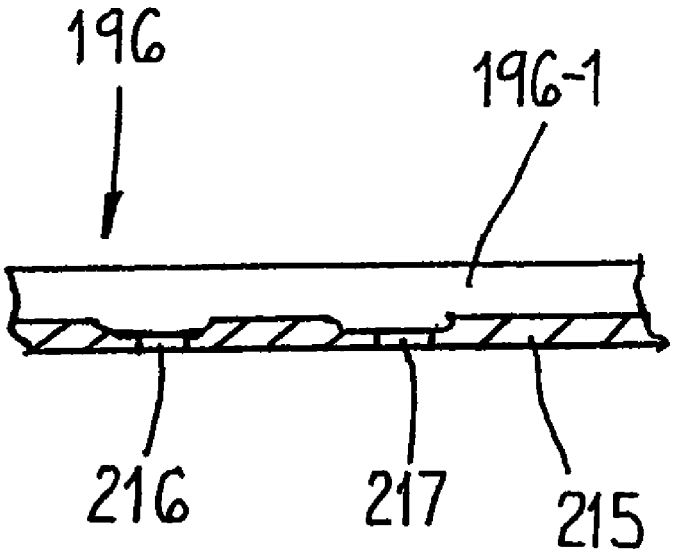
FIG. 26 is a side cross-sectional view of the suspension membrane.

As to the rim 205, the rim 205 is formed with vertical projections or posts 205-1 which project vertically from a top rib surface 205-2. As seen in FIG. 25, the posts 205-1 have an enlarged, pointed head for engagement with the cover pad 196.

The rim 205 also has holes 205-3 spaced between each pair of posts 205-1. The holes 205-3 are provided to receive mold material therethrough for fixed securement of the cover pad 196 to the rim 205.

Figure 27:
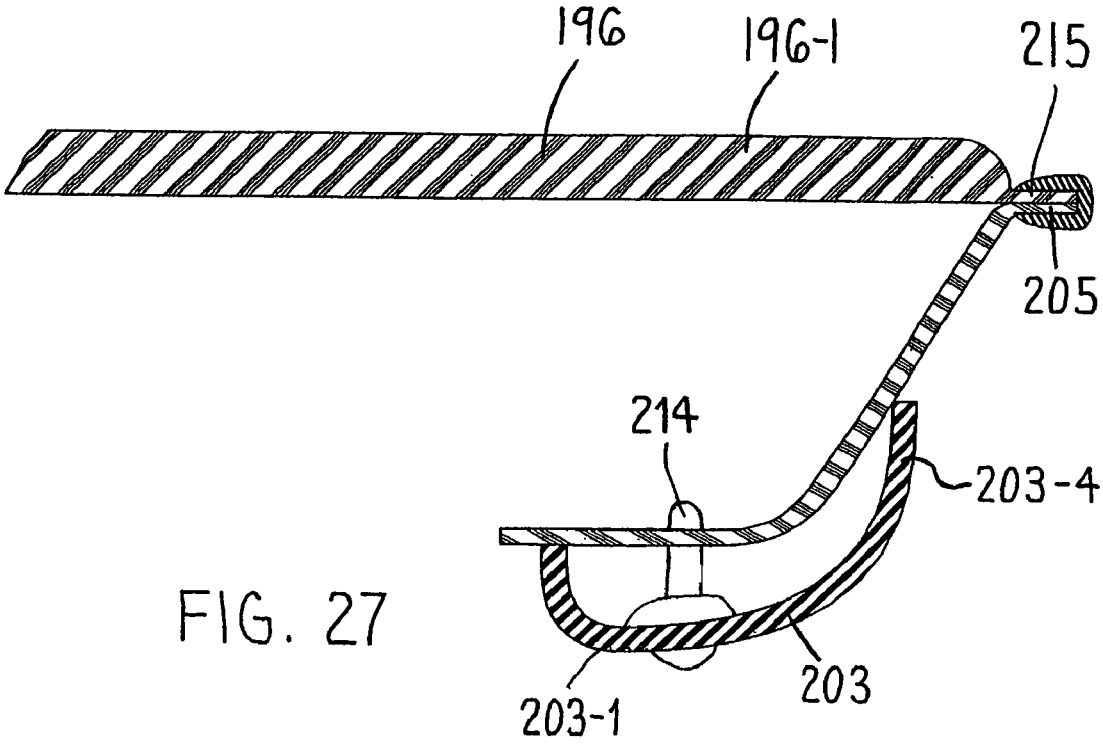
FIG. 27 is a front view of a membrane/shell assembly.
Figure 28:
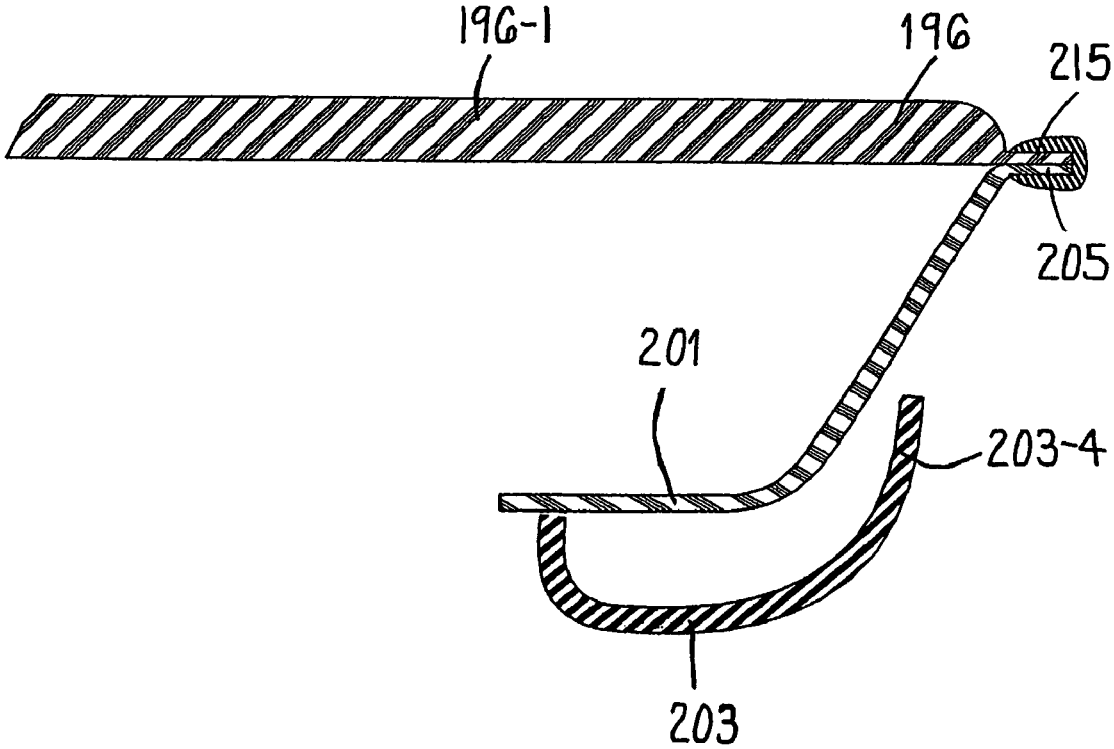
FIG. 28 is a front view of the membrane/shell assembly prior to fastening.

Referring to FIGS. 27 and 28, the shell 195 preferably is formed so that each side of the bottom wall thereof is normally raised slightly and are angled inwardly from the side walls 203-4 which project vertically from the bottom frame wall 203. However, when a fastener 214 (FIG. 27) is threaded through the anchors 203-1 and the holes 202, the support shell 195 is drawn downwardly and the sides thereof are drawn outwardly tight against the side walls 203-4. In effect, the shell 195 is flexed to spread the rim 205 outwardly to thereby increase the overall lateral width of the rim 205.

Referring to FIG. 31, the cover pad 196 includes a peripheral edge 215 which is fixed in place on the corresponding rim 205 of the seat shell 195 so as to be suspended therefrom. The pad 196 forms the cushion for the seat and the front portion 216 thereof is adapted to flex downwardly in unison with the front shell section 206.

In particular, the edge 215 is compressed relative to a thick central section 196-1. The edge section 215 includes a plurality of alternating holes 216 and 217 which are respectively adapted to align with the posts 205-1 and the holes 205-3. The holes 216 receive the posts 205-1 vertically therethrough to fix the pad 196 on the rim 205 and also locate and hold the pad 196 laterally in place. Additionally, the holes 217 are aligned with the mold holes 205-3 as described herein.

Additionally, a peripheral trim piece 218 is either fixed onto or molded in place on the edge of the pad 196 and the shell 195. When molded in place, the holes 217 and 205-3 receive the mold material of the trim piece 218 vertically therethrough such that the trim piece 218, pad edge 215 and rim 205 are fixedly and rigidly joined together.

Where the trim piece 218 is formed separate and fitted in place, the trim piece 218 may be made of an elastically stretchable material for stretching of the trim piece 218 and fitting onto the rim 205. In this case, the holes 217 and 205-3 may be omitted. Rather, mechanical fasteners, such as staples, or adhesives could be applied to the rim 205 to prevent dislodgement of the pad 196.

Therefore, with this arrangement, locator pins 205-1 are provided in combination with mechanical connection means such as molding, stapling, adhesives or the like.

During installation of the pad 196, the pad 196 has little if any tensioning. Lateral or horizontal tensioning of the pad 196 is accomplished by flexing the shell 195 downwardly by the fasteners 214 to thereby spread the rim 205 outwardly. Accordingly, tensioning of the pad 196 is accomplished through the spreader configuration of the shell 195 and frame 23-1. It also is possible to provide an adjustment mechanism to permit manual control of the flexing of the shell 195 by a chair occupant for selective tensioning of the pad 196.

The illustrated arrangement furthermore is equally usable for the multi-layer pad 196 or a single layer fabric material such as that described above. Still further, by selective placement of fasteners 214 either in the side-to-side direction or front-to-back direction, the shell 195 may be selectively flexed laterally or forwardly to tension the shell 195 effectively in any horizontal direction and even with different tensions in the lateral and forward directions.

Although particular embodiments of the invention have been disclosed in detail for illustrative purposes, it will be recognized that variations or modifications of the disclosed apparatus, including the rearrangement of parts, lie within the scope of the present invention.

What is claimed is:

1. In a chair adapted to be supported on a floor so as to support the seat and back of a chair occupant, said chair comprising:

a base adapted to be supported on the floor;

a rigid seat frame supported on said base which is configured to support the weight of the chair occupant, said seat frame comprising rigid side frame rails which are spaced apart in a side-to-side direction and which extend along opposite sides of the chair in a front-to-back direction; and a suspension seat assembly adapted to be connected to said side frame rails and thereby defining an upward facing support surface for supporting the seat of the chair occupant, said suspension seat assembly comprising a seat shell and an elastomeric suspension fabric having a peripheral edge connected to said seat shell, said seat shell comprising a plurality of sidewardly spaced, side shell sections and a rear shell section which extend in a generally U-shape, and an enlarged front panel which extends a substantial distance in the front-to-back direction from a front edge of said sheet shell proximate to a middle portion of said seat shell to support the thighs of the chair occupant, said front panel and said side and rear shell sections being joined together in a generally annular shape to define a suspension opening wherein said peripheral edge is connected to said front panel and said side and rear shell sections of said seat shell, said side shell sections being fixedly mounted to said side frame rails with said suspension fabric being suspended within said suspension opening of said seat shell to support the seat of the chair occupant and said front panel extending forwardly from said side frame rails in cantilevered relation therewith to support the thighs.

2. The chair according to claim 1, wherein said front panel and said side and rear shell sections are molded together in a one-piece construction.

3. The chair according to claim 1, wherein said peripheral edge of said suspension fabric is encapsulated within the shell material of said seat shell that defines said side and rear shell sections and said front panel.

4. The chair according to claim 3, wherein said seat shell is molded out of said shell material.

5. The chair according to claim 1, wherein said suspension seat assembly is rigidly connected to and is only supported along the opposite side edges of the suspension seat assembly by connection of said side shell sections to said side frame rails.

6. The chair according to claim 5, wherein said side shell sections and said side frame rails have interconnecting connector parts that allow for an interconnected fastener-free connection therebetween.

7. In a chair configured to support a chair occupant thereon, said chair including a body support unit configured to support a supported portion of the occupant, the body support unit comprising:

a rigid support frame; and a suspension assembly mounted to said support frame, said suspension assembly comprising a support shell having an interior wall adapted to be fixedly mounted to said support frame and having a pair of rim sections which are elongate and extend generally in the same direction in spaced apart relation to define an interior opening therebetween in the region of which the supported portion of the occupant body will be supported, said interior wall extending between said rim sections, and said suspension seat assembly further including a flexible, sheet-like suspension member connected to said rim sections so that said suspension member extends between the rim sections and supports the occupant thereon, said interior wall having an initial shape wherein engagement portions thereof are spaced from said support frame with said rim sections being disposed in an initial position, said seat assembly including engagement members which engage between said support frame and said engagement portions of said interior wall which displace said engagement portions from said initial position to an adjusted position to thereby displace said rim sections away from each other and set the tension of said suspension member, said engagement members being adjustable to thereby adjust said tension.

8. The chair according to claim 7, wherein said support shell is formed of a molded material that is resiliently deflectable.

9. The chair according to claim 8, wherein said engagement members comprise fasteners which extend through the support frame and fixedly engage the interior wall so as to draw said interior wall toward said support frame and effect said adjustment of said rim sections.

10. The chair according to claim 9, wherein said body support unit is positioned to support the seat of a chair occupant.

11. The chair according to claim 7, wherein the suspension member comprises a cushioned pad having a peripheral edge, wherein said peripheral edge and said rim sections include cooperating openings and pins which engage with each other to initially position said suspension member on said support shell with said engagement members being adjusted to thereby tension said suspension member.

12. The chair according to claim 11, wherein said cushioned pad comprises an elastomeric layer, a cushion material and a cover material which are joined together in facing relation to define a multi-layer composite structure.

13. The chair according to claim 12, wherein trim sections are provided to overly and cover said cooperating pins and openings.

14. In a chair configured to support a chair occupant thereon, said chair including a body support unit configured to support a supported portion of the occupant, the body support unit comprising:

a rigid support frame comprising frame rails that are spaced apart from each other to define a suspension opening therebetween; and a suspension assembly adapted to be connected to said frame rails and thereby defining a support surface for supporting the supported portion of the occupant, said suspension assembly comprising a composite cushioned pad which overlies said frame and said suspension opening and has a peripheral edge which is secured to said frame rails so that said composite pad extends over and is suspended across said suspension opening and is adapted to support said supported body portion, said composite pad being defined by multiple opposing material layers comprising an elastomeric layer disposed interiorly in a taut condition for resiliently supporting and resisting forces of the chair occupant, a compressible cushion layer overlying said elastomeric layer which is formed of a cushion material, and an exposed, exterior cover layer formed of a cover material which overlies said cushion material, wherein said elastomeric layer, said cushion layer and said cover layer are disposed one above the other and are unified together about said peripheral edge in facing relation to define a unitary, multi-layer composite structure which mounts to said support frame, said multiple material layers of said composite pad having said peripheral edge defined solely by said multiple material layers which are compressed and integrally bonded together, and said compressed peripheral edge is positionable on said frame rails and said multiple material layers of said peripheral edge are fixedly secured to said frame rails.

15. The chair according to claim 14, wherein said peripheral edge is bonded together by heat fusing.

16. The chair according to claim 14, wherein said cushion layer is compressible and meltable about the peripheral edge thereof to secure the suspension layer with the cover layer, said suspension layer and said cushion layer further being air permeable to permit air flow therethrough to the supported portion of the occupant.

17. The chair according to claim 14 wherein said peripheral edge has a compressed first thickness which is less than an uncompressed second thickness of said cushioned edge pad in a central region thereof.

18. The chair according to claim 14, which further includes mechanical connection means for engaging and securing said peripheral edge to said support frame when positioned thereon.

* * * * *